US009359117B2

(12) United States Patent
Russell et al.

(10) Patent No.: US 9,359,117 B2
(45) Date of Patent: Jun. 7, 2016

(54) CONTAINER CLOSURE

(71) Applicant: Berry Plastics Corporation, Evansville, IN (US)

(72) Inventors: Mark N Russell, Boonville, IN (US); Charles E Luker, Evansville, IN (US)

(73) Assignee: Berry Plastics Corporation, Evansville, IN (US)

( * ) Notice: Subject to any disclaimer, the term of this patent is extended or adjusted under 35 U.S.C. 154(b) by 0 days.

(21) Appl. No.: 14/216,208

(22) Filed: Mar. 17, 2014

(65) Prior Publication Data

US 2014/0263151 A1 Sep. 18, 2014

Related U.S. Application Data

(60) Provisional application No. 61/801,281, filed on Mar. 15, 2013.

(51) Int. Cl.

| | |
|---|---|
| ***B65D 41/34*** | (2006.01) |
| ***B65D 51/16*** | (2006.01) |
| ***B65D 51/14*** | (2006.01) |

(52) U.S. Cl.

CPC ..... *B65D 51/1661* (2013.01); *B65D 51/145* (2013.01)

(58) Field of Classification Search

CPC ..... B65D 51/145; B65D 41/0442; B65D 41/045; B65D 41/3409; B65D 41/3428; B65D 51/1661

USPC ..... 215/276, 331, 349–351; 220/319, 220/DIG. 6

See application file for complete search history.

(56) References Cited

U.S. PATENT DOCUMENTS

| | | | | |
|---|---|---|---|---|
| 5,258,191 | A | 11/1993 | Hayes | |
| 6,119,883 | A * | 9/2000 | Hock et al. | 215/252 |
| 6,276,543 | B1 * | 8/2001 | German et al. | 215/252 |
| 7,611,026 | B1 | 11/2009 | Bloom et al. | |
| 8,240,491 | B2 | 8/2012 | Beecroft et al. | |
| 2004/0016758 | A1 * | 1/2004 | Richardson | 220/288 |
| 2005/0098529 | A1 | 5/2005 | Bloom et al. | |
| 2007/0017891 | A1 | 1/2007 | Herr et al. | |
| 2007/0187352 | A1 | 8/2007 | Kras et al. | |
| 2010/0140208 | A1 | 6/2010 | Parrinello et al. | |

OTHER PUBLICATIONS

PCT International Search Report and Written Opinion completed by the ISA/US on Jul. 22, 2014 and issued in connection with PCT/US2014/030360.

* cited by examiner

*Primary Examiner* — Fenn Mathew
*Assistant Examiner* — James N Smalley
(74) *Attorney, Agent, or Firm* — Barnes & Thornburg LLP

(57) ABSTRACT

A canister includes a container and a closure. The container is formed to include a product-storage region to receive products and the closure is configured to seal off a brim of the container to block access to the product-receiving container when the closure is rotated in a clockwise direction. The closure includes a lid-retainer ring and a floating lid that covers a mouth of the container.

29 Claims, 9 Drawing Sheets

CONTAINER CLOSURE

PRIORITY CLAIM

This application claims priority under 35 U.S.C. §119(e) to U.S. Provisional Application Ser. No. 61/801,281, filed Mar. 15, 2013, which is expressly incorporated by reference herein.

BACKGROUND

The present disclosure relates to closures for mounting on top of bottles or other containers, and in particular, to a closure including a floating lid and a lid-retainer ring. More particularly, the present disclosure relates to a closure that can withstand a high pressure and high temperature sterilization process known as retort.

SUMMARY

According to the present disclosure a canister includes a container and a closure. The container is formed to include a product-storage region and a mouth opening into the product-storage region. The closure is coupled selectively to the container to close the mouth to block access to the product-receiving container when the closure is rotated in a clockwise direction. The closure includes a lid-retainer ring and a floating lid that covers a mouth of the container.

In illustrative embodiments, the closure includes a lid-retainer ring and a floating lid both made of plastic materials. When the closure is coupled to the container, the lid-retainer ring couples the floating lid to the container.

In illustrative embodiments, the canister further includes torque-limiting means for limiting an amount of torque applied to the closure during installation of the closure on the filler neck of the container. The amount of torque is limited by blocking rotation of the closure relative to the filler neck so that a pre-determined sealing force is established between the floating lid and the filler neck.

In illustrative embodiments, the torque-limiting means includes a shoulder provided by the second end of the annular side wall and a barrier ring coupled to the filler neck. The barrier ring is arranged to extend away from the filler neck toward the annular side wall to mate with the shoulder and engage the shoulder to block rotation of the lid-retainer ring when the pre-determined sealing force is established between the floating lid and the filler neck In illustrative embodiments, the closure further includes fluid-drainage means for draining a fluid from an upwardly facing outer surface of the floating lid through an interior region formed in the lid-retainer ring and out a lower aperture formed in the lid-retainer ring. The fluid-drainage means are formed when the floating lid is trapped between a filler neck included in the container and the lid-retainer ring.

In illustrative embodiments, the lid-retainer ring further includes lid-removal means for overcoming a vacuum pressure in the product-storage region acting on a portion of the downwardly facing inner surface. As a result, the floating lid is pried off the filler neck of the container during removal of the closure from the container.

Additional features of the present disclosure will become apparent to those skilled in the art upon consideration of illustrative embodiments exemplifying the best mode of carrying out the disclosure as presently perceived.

BRIEF DESCRIPTIONS OF THE DRAWINGS

The detailed description particularly refers to the accompanying figures in which:

FIG. 1 is a cross-sectional view taken along line 1-1 of FIG. 2 of a canister in accordance with the present disclosure showing that the canister includes a container and a closure coupled to the container, the container includes a body and a filler neck coupled to the body, the closure includes a floating lid and a lid-retainer ring, the closure mates with the filler neck to seal an opening into the container, and the closure includes an annular torque inhibitor to limit sealing pressure between the filler neck and floating lid, as suggested in FIGS. 3 and 4, and a drainage flow passageway to allow fluid located on top of the closure to drain out the bottom of the closure, as suggested in FIGS. 5-8;

Figure 2:
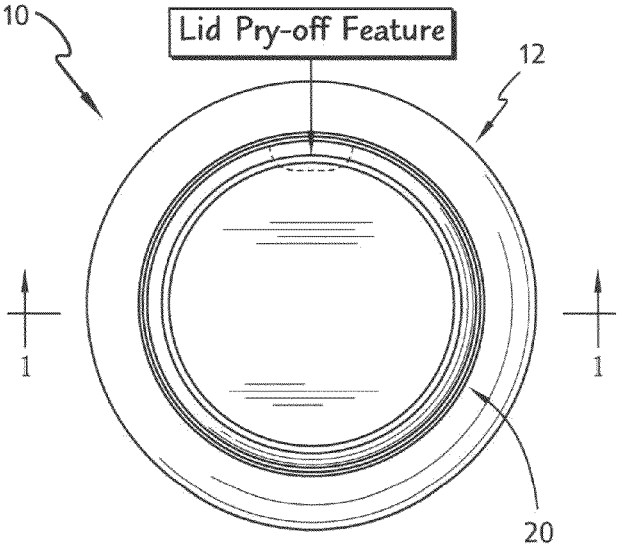
FIG. 2 is a top plan view of the canister showing the closure and a portion of the container, and that the closure includes a lid pry-off feature for removing the lid from the container as suggested in FIGS. 9-12.
Figure 5:
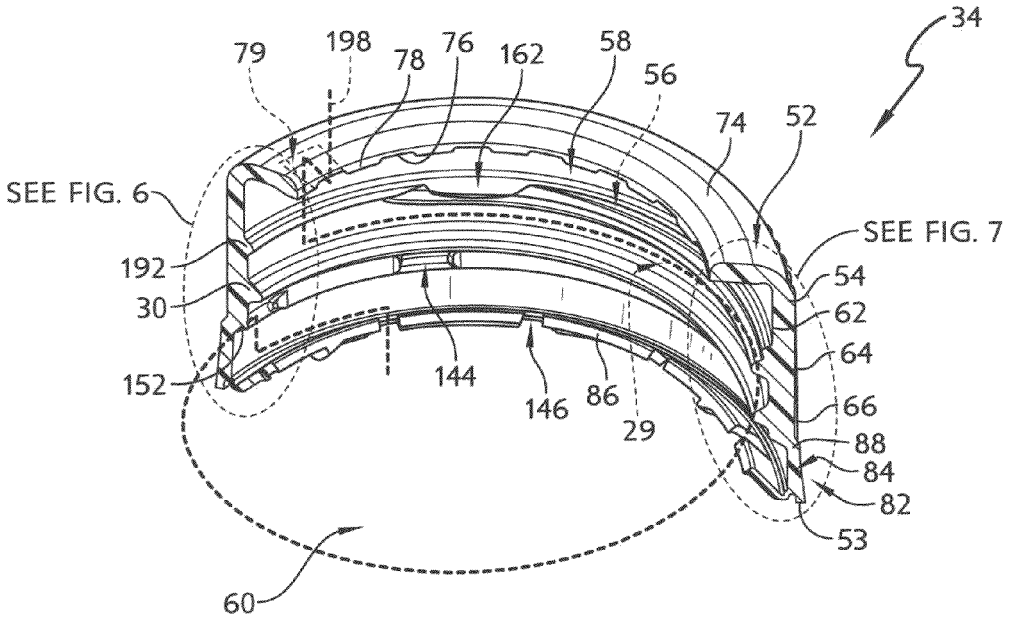
FIG. 5 is an upper perspective view of the lid-retainer ring of FIG. 2 with portions broken away to reveal a flow path through the drainage flow passageway, as suggested in FIGS. 6-8.
Figure 7:
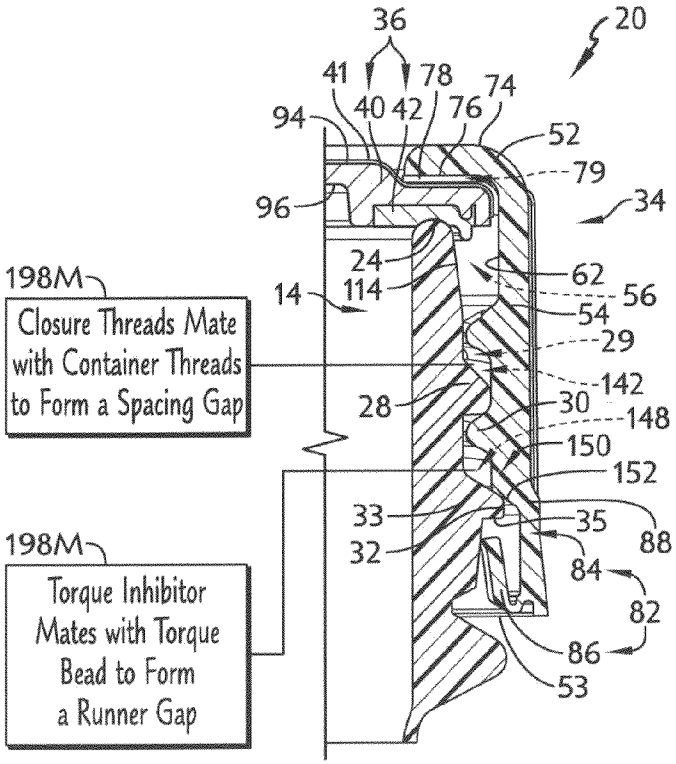
Figure 6:
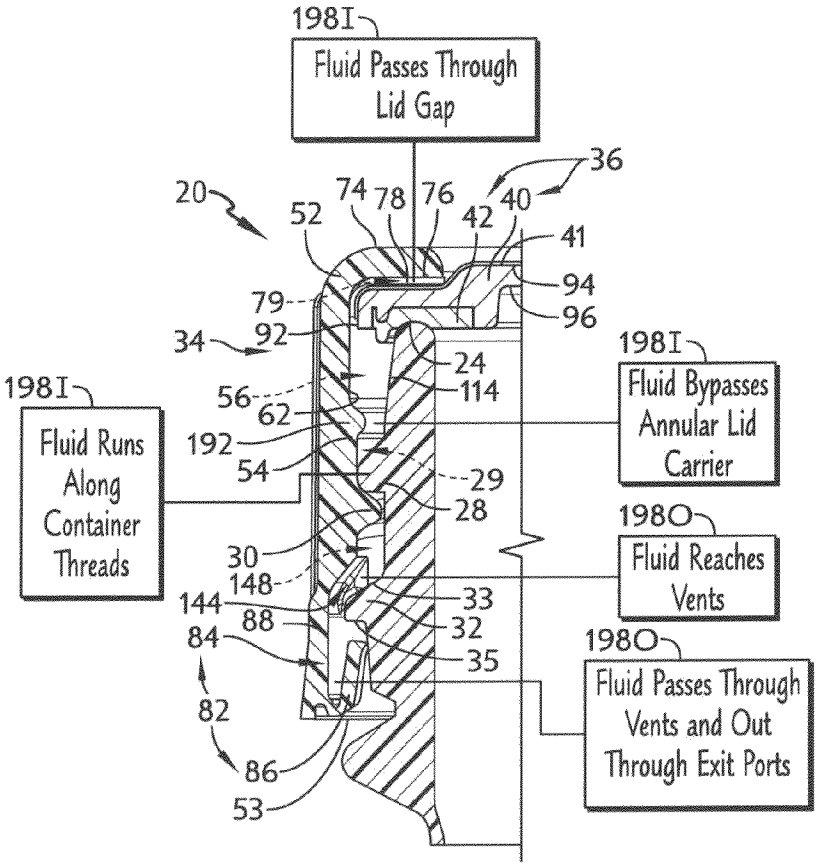
Figure 8:
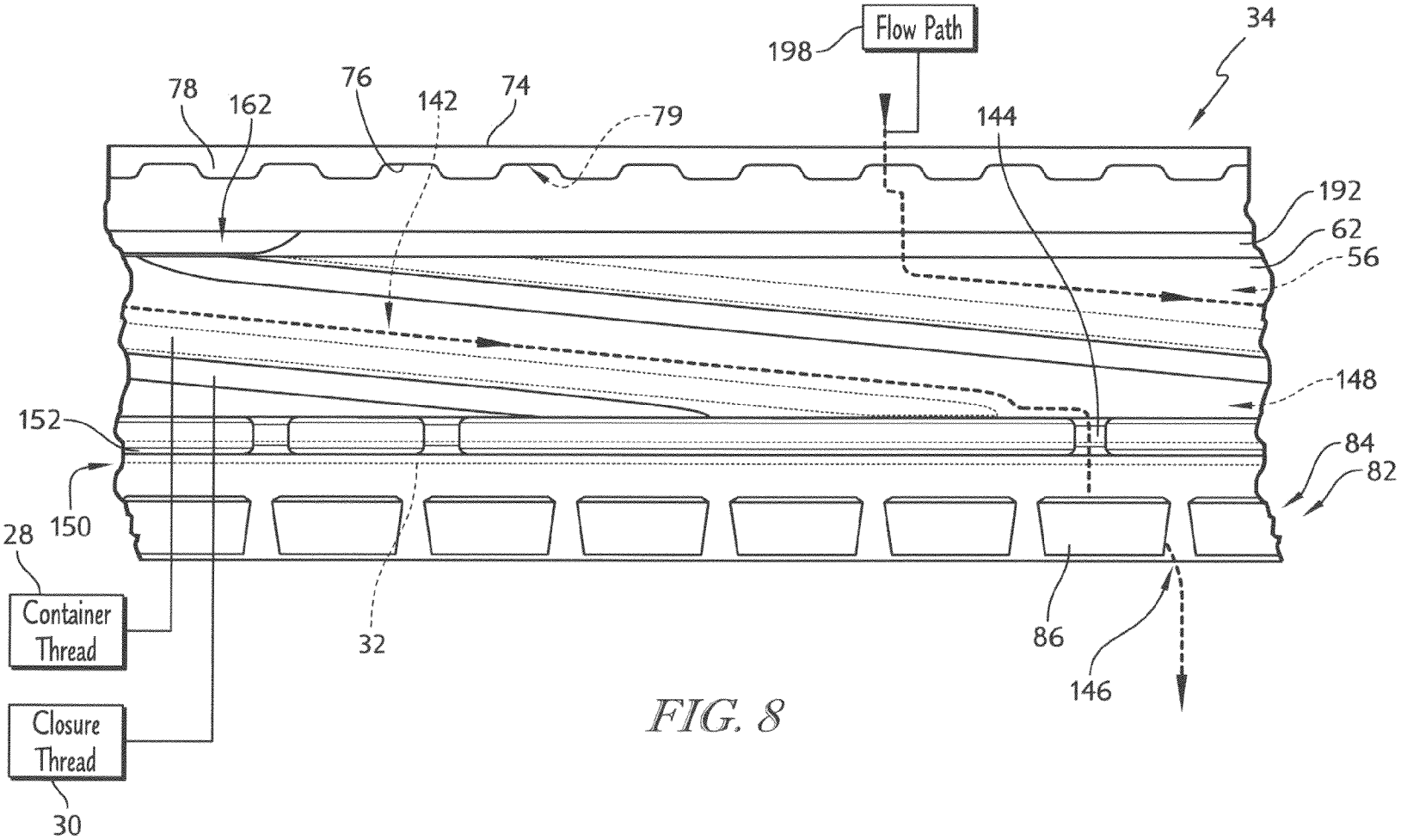
Figure 9:
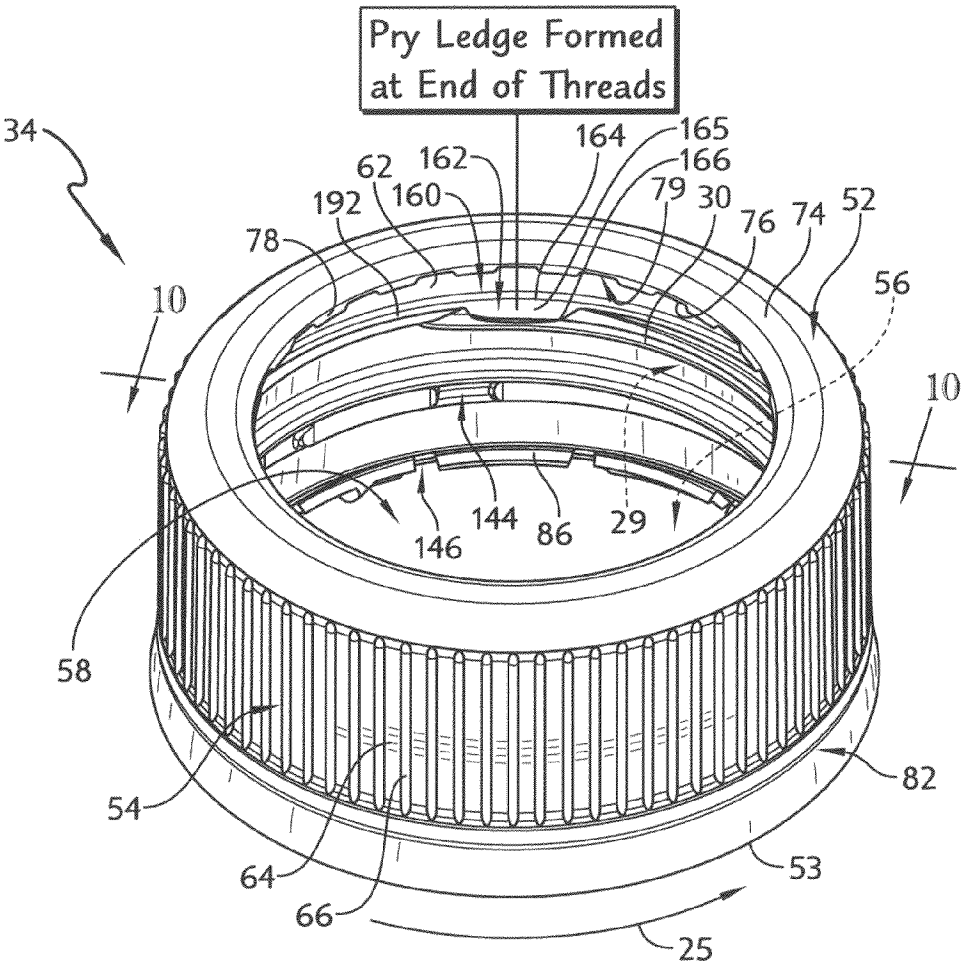
Figure 11:
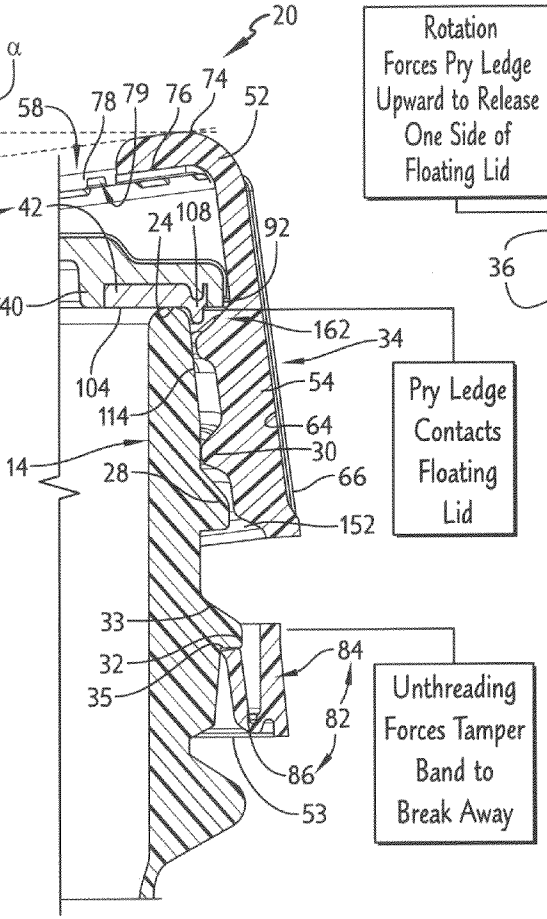
Figure 10:
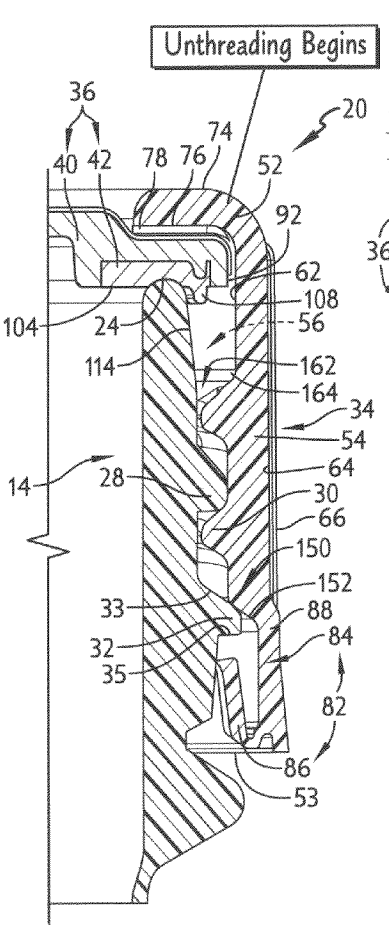

FIG. 6 is an enlarged view of the lid-retainer ring of FIG. 5 showing an upper in-flow portion of the flow path where fluid on the top of the floating lid passes under lid gaps formed between the lid spacers, drops to the closure threads, and follows the closure threads, and a lower out-flow portion of the flow path where the fluid passes through a fluid vent cut into the shoulder and drops out of fluid exit ports located between retention tabs at the bottom of the lid-retainer ring;

FIG. 7 is an enlarged view of the lid-retainer ring of FIG. 5 showing a mid-flow portion of the flow path where fluid flows through a spacing gap formed between the closure threads and container threads and a runner gap formed between the shoulder and torque bead;

FIG. 8 is a flat development of the interior of the lid-retainer ring of FIG. 5 showing the container threads and torque bead in phantom as they mate with the closure threads and annular shoulder, respectively, and showing the fluid flow path as it passes through the lid gaps at the top of the lid-retainer ring, follows the closure threads to the annular shoulder, and flows through the vents and exit ports out the bottom of the lid-retainer ring;

FIG. 9 is an upper perspective view of the lid-retainer ring of FIG. 2 showing that a pry ledge is formed at the end of the closure threads to move therewith as the lid-retainer ring is rotated during removal of the closure from the container, as suggested in FIGS. 10-13;

FIG. 10 is a partial cross-sectional view taken along the line 10-10 of FIG. 9 showing the floating lid sealed with the filler neck as unthreading of the closure begins;

FIG. 11 is a partial cross-sectional view similar to FIG. 10 showing that the unthreading motion has caused the lid-retainer ring to be elevated, the pry ledge to be in contact with a lower portion of the floating lid which is still sealed to the filler neck due to vacuum pressure within the container formed during a sterilization process, as suggested in FIGS.

Figure 12:
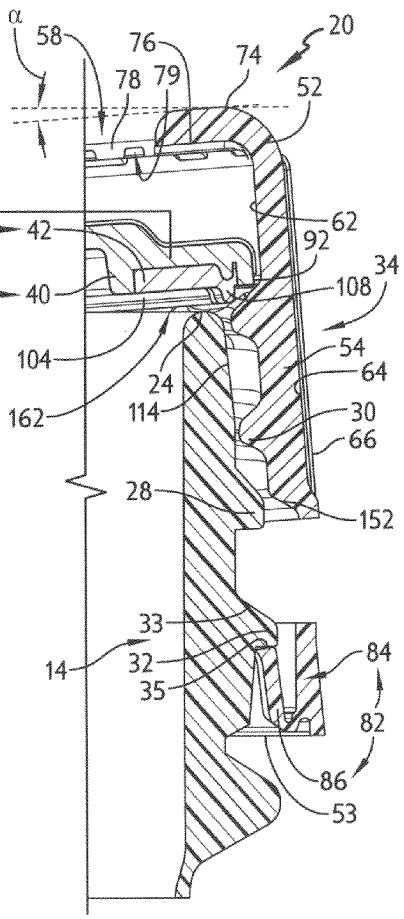
Figure 13:
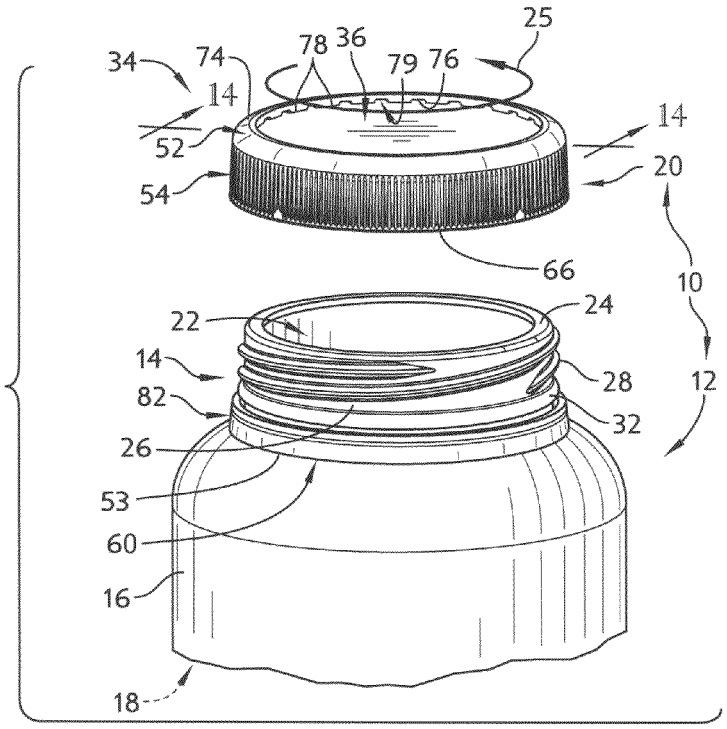
Figure 14:
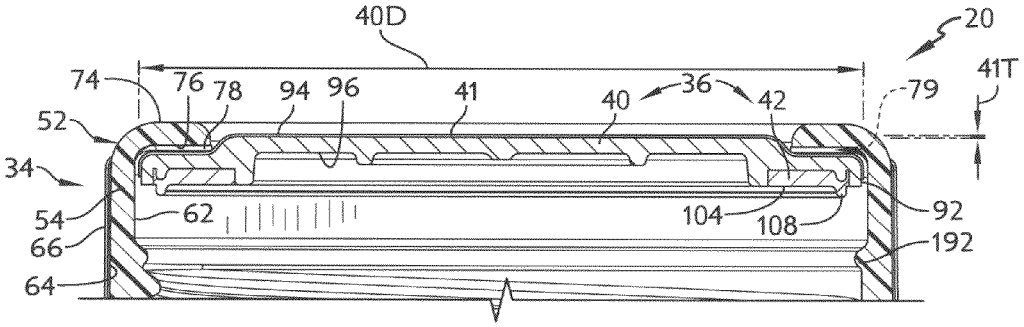
Figure 15:
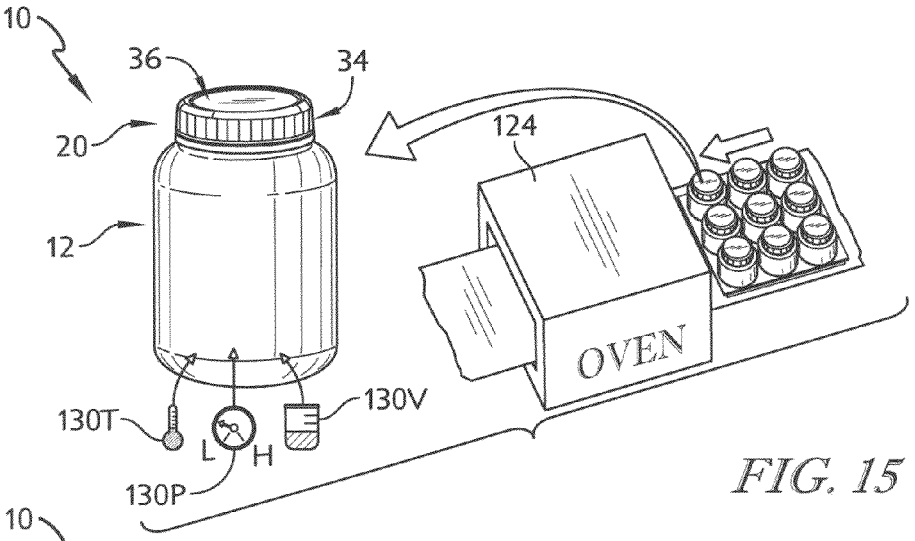
Figure 16:
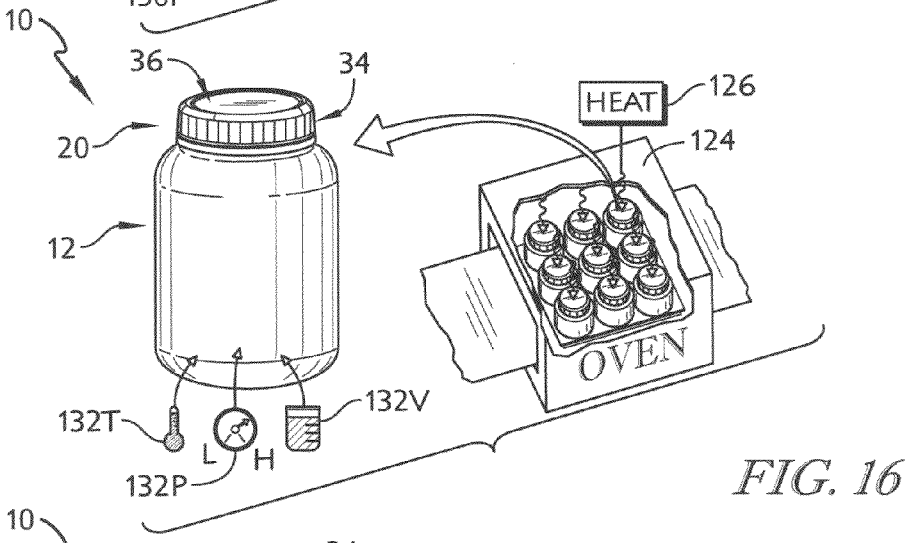
Figure 17:
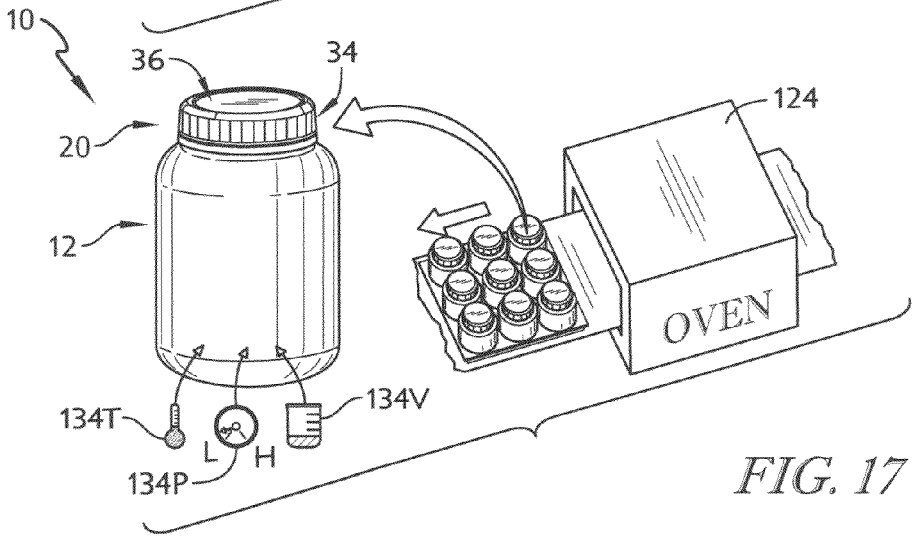

15-17, and a tamper band to break away from the bottom of the lid-retainer ring after engaging a lower surface of the torque bead;

FIG. 12 is a partial cross-sectional view similar to FIG. 11 showing that continued unthreading motion raises the pry ledge and forces the floating lid to release form the filler neck;

FIG. 13 is a perspective view of the closure and container of FIG. 2 showing the closure separated from the filler neck of the container after counter-clockwise rotation of the closure and that the floating lid is contained within the lid-retainer ring to move therewith when the closure is not secured on the container;

FIG. 14 is a partial cross-sectional view taken along the line 14-14 of FIG. 13 showing the floating lid is sized to provides spacing between a perimeter edge of the floating lid and an inner surface of the lid-retainer ring to allow fluid flow while being large enough to contact an annular lid carrier formed on the lid-retainer ring which retains the floating lid within an interior region of the lid-retainer ring;

FIG. 15 is a diagrammatic view showing a tray carrying nine canisters in accordance with the present disclosure and moving along a conveyor toward an oven and showing an enlarged perspective view of one of those before it is heated and pressurized in the oven and showing that the canister comprises the closure mounted on the filler neck included in the container;

FIG. 16 is a view similar to FIG. 15 showing that the tray has moved into a hot oven to heat each of the nine canisters and an enlarged perspective view of the canister that was singled out and shown in FIG. 15 and the high temperatures in the oven lead to an increase in pressure in the product-storage region formed in the canister during sterilization of the contents of the canister to increase the volume of the product-storage region provided in the canister without bursting or damaging the canister even though the pressure inside the canister increased when the canister was heated; and FIG. 17 is a view similar to FIGS. 15 and 16 showing the canister after it has gone through the retort process.

DETAILED DESCRIPTION

Figure 1:
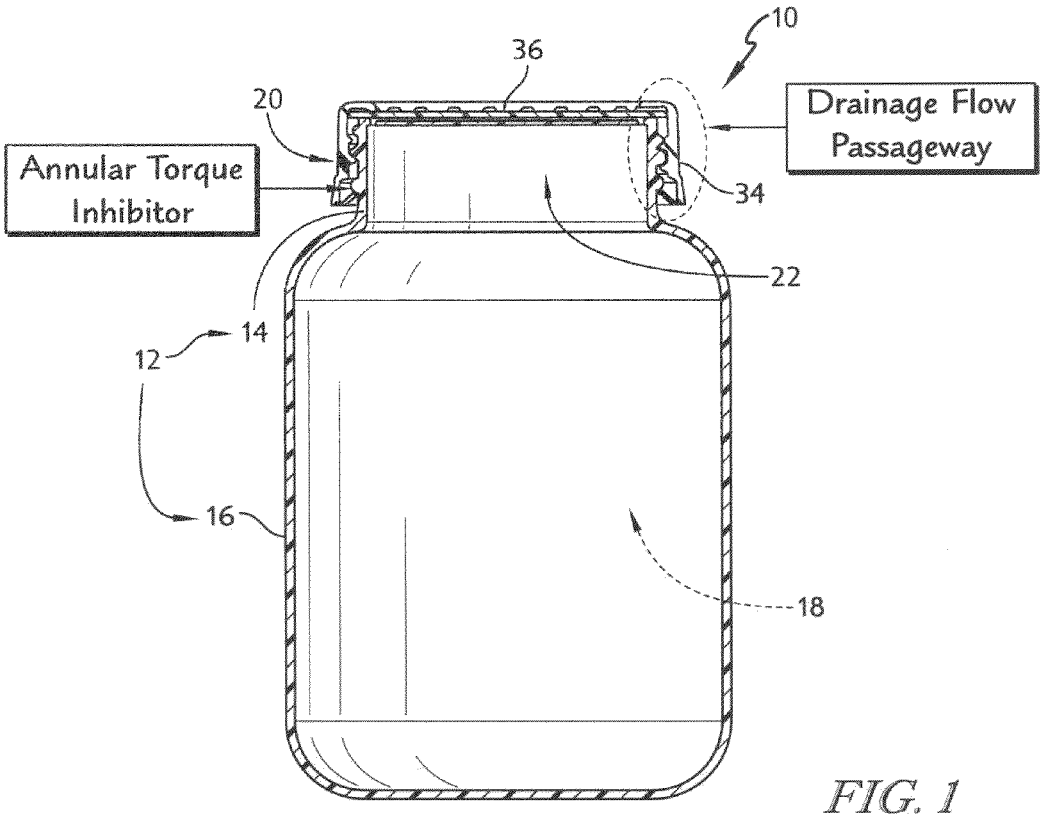

A canister 10 in accordance with the present disclosure includes a container 12 formed to include a product-storage region 18 and a closure 20, as shown, for example, in FIGS. 1 and 2. Closure 20 is configured to be coupled to container 12 to close a mouth 22 and block access to product-storage region 18. Closure 20 includes a lid-retainer ring 34 and a floating lid 36 that covers mouth 22. Closure 20 may be separated from container 12 to allow access to product-storage region 18 through mouth 22 formed in container 12 as shown, for example, in FIG. 13.

Figure 3:
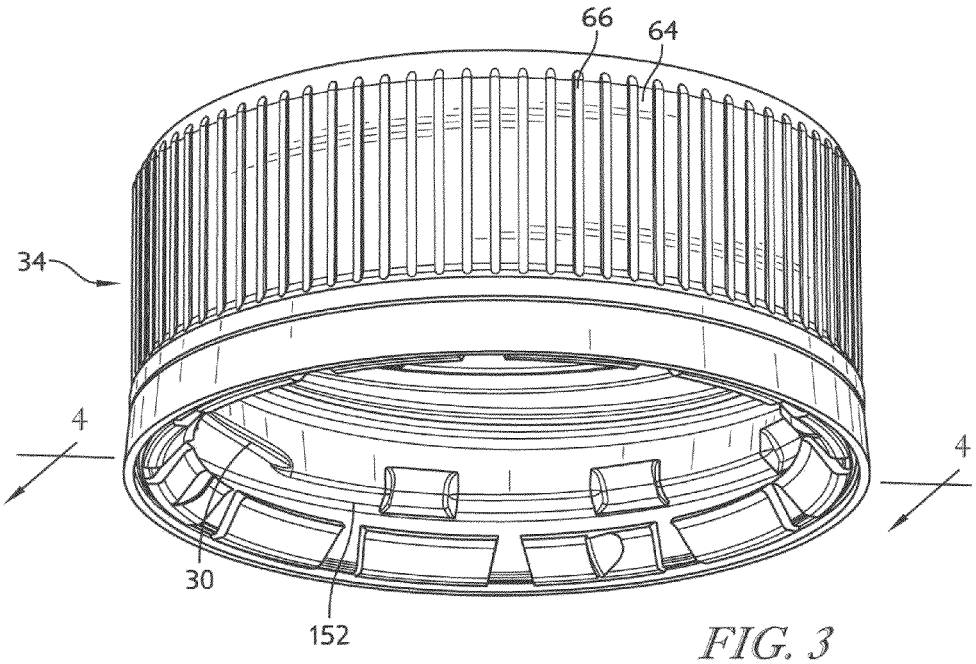
FIG. 3 is a lower perspective view of the closure of FIG. 2 showing that the lid-retainer ring includes closure threads to mate with container threads on the filler neck to force the floating lid against the filler neck to seal the opening into the container and a shoulder positioned to inhibit over-torqueing of the closure.
Figure 4:
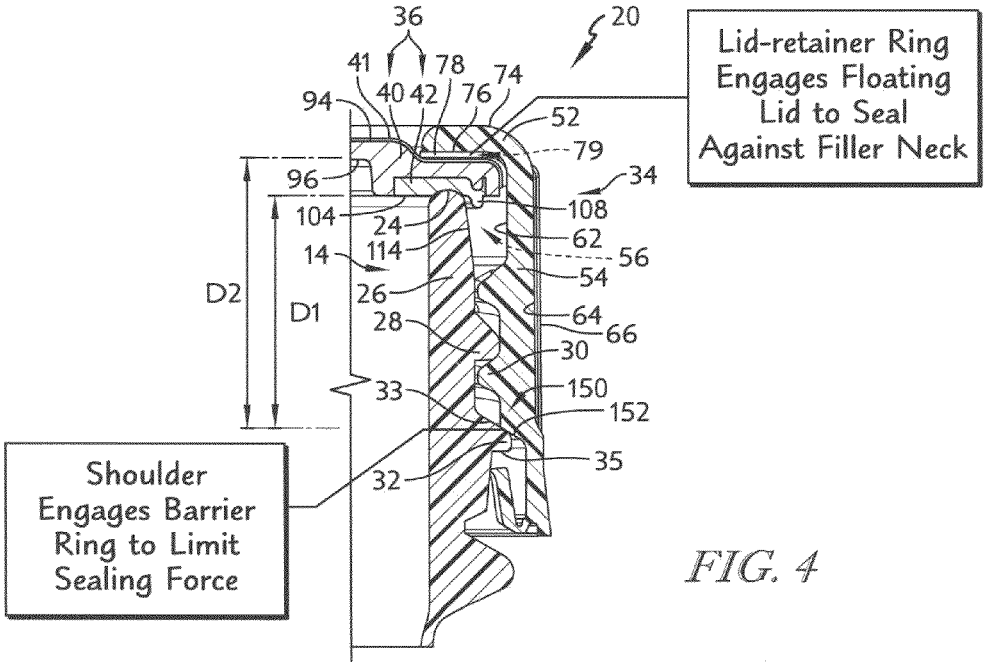
FIG. 4 is a cross-sectional view taken along the line 4-4 of FIG. 3 showing that the shoulder is positioned to allow lid spacers included on the lid-retainer ring to engage the floating lid to form a seal against the filler neck and engage a torque bead positioned on the filler neck to limit the sealing force exerted in the floating lid.

Closure 20 includes a drainage flow passageway that allows fluid on top of closure 20 to drain through closure 20 and exit out a lower aperture 60 of lid-retainer ring 34 as shown in FIGS. 5-8. Canister 10 is also configured to include a torque inhibitor 150 that limits clockwise rotation after closure 20 has been rotated a predetermined amount relative to filler neck 14 of container 12 as shown in FIGS. 3-4. Closure 20 further includes a lid pry-off feature 160 that assists with removal of floating lid 36 from mouth 22 of container 12 as closure 20 is rotated in a counter-clockwise manner as shown in FIGS. 9-12. Closure 20 and container 12 are configured to withstand a high temperature and high-pressure sterilization process known as retort as suggested in FIGS. 15-17.

Canister 10 is configured to store food or other products in product-storage region 18 as shown in FIG. 1. Container 12 includes a body 16, a filler neck 14 coupled to body 16, and a barrier ring 32 coupled to filler neck 14 as shown in FIG. 4. Body 16 and filler neck 14 cooperate to define product-storage region 18. Mouth 22 is formed in filler neck 14 and is arranged to open into product-storage region 18 to allow communication therewith. Closure 20 is configured to mount on filler neck 14 of container 12 to cover mouth 22. As suggested in FIG. 13, closure 20 is configured to be removed from filler neck 14, and thus, allow communication with product-storage region 18 when closure 20 is twisted in a counter-clockwise direction as indicated by arrow 25 in FIG. 13. Barrier ring 32 is coupled to filler neck 14 adjacent to where filler neck 14 is coupled to body 16. Barrier ring 32 extends radially outward from filler neck 14.

Filler neck 14 includes a brim 24, a neck wall 26, and one or more container threads 28 as shown in FIG. 4. Brim 24 is formed to mate with floating lid 36 to create a seal between brim 24 and floating lid 36. Neck wall 26 extends downwardly from brim 24 and is coupled to body 16 of container 12. Brim 24 and neck wall 26 are annular and are formed to define mouth 22. Container threads 28 are coupled to neck wall 26 and extend radially outwardly and away from both neck wall 26 and mouth 22. Container threads 28 cooperate with one or more closure threads 30 included in closure 20 to enable closure 20 to mate with filler neck 14.

Closure 20 includes lid-retainer ring 34 and floating lid 36 as illustrated in FIG. 1. Lid-retainer ring 34 is configured to trap floating lid 36 when closure 20 is uncoupled from container 12 as shown in FIGS. 13 and 14. Lid-retainer ring 34 is configured to mate with filler neck 14 to trap floating lid 36 between lid-retainer ring 34 and brim 24 of filler neck 14 as shown in FIGS. 1, 4, 6, 7, and 10-12. Floating lid 36 is configured to seal product-storage region 18 when closure 20 is mated with container 12.

Lid-retainer ring 34 includes a top wall 52 and an annular side wall 54 coupled to top wall 52 to extend downwardly from top wall 52 and terminate at a bottom edge 53 as shown in FIGS. 6 and 7. Top wall 52 and annular side wall 54 are formed to define an interior region 56 of lid-retainer ring 34. An upper aperture 58 is formed in top wall 52 and opens into interior region 56, as shown in FIG. 5. A lower aperture 60 is spaced apart from upper aperture 58 and is formed in annular side wall 54 to open into interior region 56. Lower aperture 60 and interior region 56 are sized to receive filler neck 14 and floating lid 36. Upper aperture 58 is sized such that filler neck 14 and floating lid 36 are blocked from passing through upper aperture 58.

Annular side wall 54 includes an inner surface 62 and an outer surface 64 as shown in FIG. 4. In illustrative embodiments, outer surface 64 includes a number of vertical ribs 66 as shown in FIG. 3. Each vertical rib 66 may be spaced equidistant from the next closest vertical rib 66. The number of vertical ribs 66 aid a user of canister 10 to grip lid-retainer ring 34 when mating and removing closure 20 and container 12.

Inner surface 62 of annular side wall 54 includes one or more closure threads 30, a shoulder 152, and a lid pry-off feature 160 as shown in FIG. 4. Closure threads 30 extend inwardly into interior region 56. A thread gap 29 extends between upper and lower sections of closure threads 30 as shown in FIGS. 5-7. Thread gap 29 is formed to mate with one or more container threads 28 included on filler neck 14. Thread gap 29 and container threads 28 cooperate such that when closure 20 is mated to filler neck 14, twisting closure 20 in a first direction causes closure 20 to become coupled to filler neck 14 and rotating closure 20 in a second direction opposite the first direction, causes closure 20 to separate from filler neck 14. In illustrative embodiments, the first direction may be clockwise and the second direction may be counter-clockwise.

Closure 20 includes torque inhibitor 150 to control the torque and subsequent compressive forces between brim 24 of filler neck 14 and floating lid 36 when closure 20 is mounted on container 12 as shown in FIGS. 3 and 4. Torque inhibitor 150 includes barrier ring 32 of container 12 and shoulder 152 formed on inner surface 62 of lid-retainer ring 34. Barrier ring 32 is fixedly coupled to filler neck 14 to be a predetermined distance D1 from brim 24. Similarly, shoulder 152 is fixedly coupled to inner surface 62 to be a predetermined distance D2 from top wall 52 of lid-retainer ring 34. In one illustrative embodiment, the distances D1, D2 may be set in relation to the thickness of the floating lid 36 such that a predetermined sealing force is created between the filler neck 14 and floating lid 36 when the closure 20 is mounted on the container 12.

Barrier ring 32 includes a top bead surface 33 and a bottom bead surface 35 as shown in FIG. 4. Top bead surface 33 may be angled downwardly as it extends radially outwardly from filler neck 14. Shoulder 152 extends radially outward of inner surface 62. Shoulder 152 may be angled downwardly as it extends radially outward from inner surface 62.

Barrier ring 32 is configured to extend radially past inner surface 62 when closure 20 is coupled to container 12 as shown in FIG. 4. As closure 20 is being screwed onto container 12, top bead surface 33 of barrier ring 32 abuts against shoulder 152 forming annular torque inhibitor 150. Angled bead surface 33 and angled shoulder 152 may be complimentary in shape such that bead surface 33 is received tightly against shoulder 152. Shoulder 152 blocks barrier ring 32 from extending past shoulder 152 into closure threads 30 on inner surface 62. In this way, barrier ring 32 is positioned below closure threads 30 and spaced apart from top wall 52 to locate shoulder 152 therebetween. This minimum distance between barrier ring 32 and top wall 52 of lid-retainer ring 34 is predetermined to reduce compressive forces from top wall 52 onto floating lid 36. Compressive forces on floating lid 36 between top wall 52 may also be minimized.

Lid pry-off feature 160 includes pry ledge 162 formed on side wall 54 as shown in FIG. 9. Pry ledge 162 is formed at an upper end of closure threads 30 and supports floating lid 36 when closure 20 is not on container 12. Pry ledge 162 may be formed at a helical angle to top wall 52 of lid-retainer ring 34. When lid-retainer ring 34 is rotated in a counter-clockwise direction to remove closure 20 from container 12, pry ledge 162 is configured to abut against floating lid 36 to pry floating lid 36 from container 12 when lid-retainer ring 34 is removed from container 12. As pry ledge 162 abuts against floating lid 36, the angled shape of pry ledge 162 provides means for lifting up on floating lid 36 to break the seal with mouth 22.

Pry ledge 162 is an annular flange that extends radially inwardly away from annular side wall 54 of lid-retainer ring 34 towards interior region 56 as shown in FIGS. 9-12. Pry ledge 162 includes a back edge 164, a front edge 166, and an inclined surface 165 that extends to front edge 166 as shown in FIG. 9. Back edge 164 is configured to be closer to top wall 52 than front edge 166.

In one illustrative embodiment, a user may unthread the closure 20 from the container 12 by rotating the lid-retainer ring 34 in a counter-clockwise rotation, as shown, for example, in FIG. 10. As unthreading continues, closure tabs 86 of the tamper band 82 contact bottom bead surface 35 to force the tamper band 82 downward as the lid-retainer ring 34 travels upwards as shown in FIG. 11. Unthreading of the lid-retainer ring 34 forces the tamper band 82 to break away therefrom.

Unthreading the lid-retainer ring 34 drives the lid-retainer ring 34 upward while a vacuum force created between the container 12 and floating lid 36 keeps the floating lid 36 in place on the filler neck 14. The helical shape of the closure threads 30 and container threads 28 cause the lid-retainer ring 34 to tilt at an angle a relative to horizontal as shown in FIG. 11. Thus, one side of the lid-retainer ring 34 is closer to the barrier ring 32 than an opposite side thereof. In the illustrative embodiment, a side of the lid-retainer ring 34 where the pry ledge 162 is located is in an elevated position relative to the opposing side of the lid-retainer ring 34 as shown in FIG. 11.

The lid-retainer ring 34 travels upward until the pry ledge 162 contacts a perimeter edge 92 of the floating lid 36. The pry ledge 162 contacts a limited portion of the perimeter edge 92 on one side of the floating lid 36 due to the size and location of the pry ledge 162 on the lid-retainer ring 34. Continued rotation of the lid-retainer ring 34 drives the pry ledge 162 upward against the perimeter edge 92 of the floating lid 36 to lift the one side of the floating lid 36 away from the brim 24 of the filler neck 14 as shown in FIG. 12. The pry ledge 162 concentrates the force applied to the floating lid 36 to one side thereof, making removal of the floating lid 36 easier than lifting the entire floating lid 36 at once. As the one side of the floating lid 36 is raised, the seal created with the filler neck 14 is broken, allowing the pressure within the container 12 to match an ambient pressure on the outside of the container 12 and reducing the vacuum force created between the container 12 and the floating lid 36. The closure 20 may then be removed from the container 12 as shown in FIG. 13.

In the illustrative embodiment, an annular lid-carrier ring 192 is coupled to the annular side wall 54 to extend radially inward into interior region 56. Top wall 52, annular side wall 54, annular lid-carrier ring 192, and pry ledge 162 cooperate to allow for limited movement of floating lid 36 in both the axial and radial directions such that floating lid 36 is blocked from escaping interior region 56.

Top wall 52 of lid-retainer ring 34 is coupled to inner surface 62 of annular side wall 54 and prevents floating lid 36 from escaping interior region 56 through upper aperture 58. As shown in FIGS. 5-8, top wall 52 includes an upper surface 74, a lower surface 76 spaced apart and opposite upper surface 74, and a number of lid spacers 78 extending from lower surface 76. Lid spacers 78 extend downwardly away from lower surface 76 toward interior region 56. Lid spacers 78 prevent floating lid 36 from engaging lower surface 76. Lower surface 76 of top wall 52 and lid spacers 78 form to create lid gaps 79. Each lid spacer 78 is spaced equidistant from the next closest lid spacer 78.

Closure 20 also includes a drainage flow passageway configured to drain fluid from on top of floating lid 36 through upper aperture 58, through interior region 56 of lid-retainer ring 34, and out through lower aperture 60 as shown in FIGS. 5-8. The drainage flow passageway includes lid gaps 79, a spacing gap 142 formed to be included between an underside portion of closure threads 30 and container threads 28, a runner gap 148 formed to be included between the underside portion of closure threads 30 and torque inhibitor 150 formed by the barrier ring 32 and shoulder 152, one or more fluid vents 144 formed in the shoulder 152, and fluid exit ports 146 near aperture 60. The drainage flow passageway allows for a continuous fluid flow path 198 to extend between the top of the floating lid 36 and the lower aperture 60, as shown, for example, in FIGS. 5 and 8.

Drainage flow passageway 140 is configured such that liquid on top of floating lid 36 drains through lid gaps 79 into interior region 56, where filler neck 14 and inner surface 62 of lid-retainer ring 34 force liquid into spacing gap 142 included in closure threads 30 as part of an upper in-flow path 198I as shown in FIG. 6. Fluid travels along closure threads 30 in spacing gap 142 to runner gap 148 as part of a central mid-flow path 198M as shown in FIG. 7. Fluid travels through runner gap 148 to vents 144 and out of lower aperture 60 through exit ports 146 as part of a lower out-flow path 198O as shown in FIG. 6.

Spacing gap 142 is located adjacent to and formed with thread gap 29 formed between closure threads 30 on inner surface 62. Spacing gap 142 and thread gap 29 are formed to be one continuous pathway as shown in FIG. 5. Spacing gap 142 provides a conduit for fluid to flow between container threads 28 and inner surface 62 of side wall 54 after fluid drains through lid gaps 79 into interior region 56. Fluid can flow through spacing gap 142 to the bottom of closure threads 30 as gravity pulls the fluid downward.

Vents 144 are formed in shoulder 152 near lower aperture 60 in order to provide a conduit for fluid to flow when barrier ring 32 is mated with shoulder 152. Fluid flows through spacing gap 142, through runner gap 148, and into vents 144 without being blocked by the interaction of barrier ring 32 with shoulder 152. Exit ports 146 are in fluid communication with vents 144 and direct fluid to flow from vents 144 out of lower aperture 60.

In an illustrative embodiment, lid-retainer ring 34 further includes a tamper band 82 coupled to annular side wall 54 as shown in FIGS. 8-12. Tamper band 82 severs from annular side wall 54 the first time closure 20 is removed from container 12 to indicate that canister 10 has been opened. Tamper band 82 includes a tamper ring 84 and a number of retention tabs 86 coupled to tamper ring 84. Tamper ring 84 is coupled to annular side wall 54 at a living hinge 88. Retention tabs 86 contact container threads 28 and deform upwardly during installation of closure 20. When closure 20 is removed from container 12, retention tabs 86 contact bottom bead surface 35 and block tamper band 82 from being removed with lid-retainer ring 34 severing tamper band 82 from annular side wall 54 at living hinge 88 as shown in FIGS. 10-12. Thus, a user of canister 10 knows that closure 20 has previously been removed from container 12 if tamper band 82 is severed from annular side wall 54. In illustrative embodiments, exit ports 146 may be formed between retention tabs 86 of tamper band 82.

Floating lid 36 is trapped inside lid-retainer ring 34 as shown in FIG. 14. Floating lid 36 includes a lid body 40, a gasket 42, and a film 41. Lid body 40 blocks products stored inside canister 10 from escaping through mouth 22. Lid body 40 includes an outer surface 94, an inner surface 96 spaced apart and opposite outer surface 94, and an outer perimeter edge 92. Gasket 42 is coupled to lid body 40 and mates with filler neck 14 to form a seal between floating lid 36 and filler neck 14 as shown in FIG. 4. Film 41 is coupled to lid body 40 to be adjacent to top wall 52 of lid-retainer ring 34 such that lid body 40 is between gasket 42 and film 41.

Gasket 42 is coupled to lid body 40, as shown in FIG. 14. Gasket 42 blocks products stored within product-storage region 18 from escaping canister 10 through mouth 22 where floating lid 36 contacts filler neck 14. Gasket 42 may be made from a thermoplastic elastomer rubber, silicon, or the like. In the illustrative embodiment, gasket 42 is ring-shaped. In other embodiments, gasket 42 may be a continuous sheet. Gasket 42 is coupled to inner surface 96 of lid body 40 adjacent perimeter edge 92 of lid body 40.

Gasket 42 includes a lower-gasket surface 104 with an annular flange 108. Annular flange 108 extends downwardly from lower-gasket surface 104 toward container 12 when closure 20 is coupled to container 12 as shown in FIG. 4. Annular flange 108 extends downwardly further than brim 24 such that annular flange 108 is located between annular side wall 54 and an outer-brim surface 114 of brim 24. Annular flange 108 may be convex when viewed in a vertical cross-section. Annular flange 108 is configured to abut against outer brim surface 114 to seal product-storage region 18 of container 12 from interior region 56. In one example, annular flange 108 may be used when irregularities in alignment or manufacturing of the container 12 are present.

Film 41 is configured to be coupled to outer surface 94 of lid body 40 as shown in FIG. 14. Film 41 may be made of any polyethylene or polypropylene material and may be suitable for printing or writing. Film 41 may be coupled to outer surface 94 of lid body 40 through any adhesive or sealant material. In illustrative embodiments, film 41 has a thickness 40T, which is about 1 mm. In illustrative embodiments, film 41 has a diameter 40D, which is about 40 mm. Diameter 40D is sized to both completely cover lid body 40 and fit inside interior region 56 of lid-retainer ring 34 as shown in FIG. 14.

Floating lid 36 is configured to be trapped between lid-retainer ring 34 and filler neck 14 when closure 20 is mated with container 12, as shown in FIG. 4. Floating lid 36 is also constrained by pry ledge 162, annular side wall 54, top wall 52, and annular lid-carrier ring 192 when closure 20 is not mated with container 12 as shown in FIG. 14. When closure 20 is mated with container 12, and closure 20 is rotated relative to container 12, container threads 28 and closure threads 30 cooperate to cause top wall 52 to move closer to brim 24. As top wall 52 moves closer to brim 24, floating lid 36 becomes trapped between top wall 52 and brim 24 closing mouth 22, causing gasket 42 to seal with brim 24.

Closure 20 mates with container 12 to form canister 10. When closure 20 is mated with container 12 and closure 20 is twisted to trap floating lid 36 between lid-retainer ring 34 and filler neck 14, mouth 22 is closed and canister 10 is sealed such that product-storage region 18 is sealed off from the atmosphere. Products may be stored in product-storage region 18 prior to mating closure 20 with container 12 to seal products inside canister 10.

Canister 10 is configured to go through a sterilization process known as retort. During retort, canister 10 and any products received in product-storage region 18 are heated and pressurized, as suggested in FIGS. 15-17. Prior to retort, products are received in product-storage region 18 of canister 10 and closure 20 is mated with filler neck 14. Before retort, the product-storage region 18 of canister 10 has a pre-retort temperature 130T, pressure 130P, and volume 130V as suggested below the enlarged perspective view of canister 10 in FIG. 15. In the illustrative embodiment, the pre-retort temperature 130T and pressure 130P are about equal to atmospheric temperature and pressure. The pre-retort volume 130V is defined by container 12 and closure 20.

During retort, a number of canisters 10 are placed on a tray and moved along a conveyer toward an oven 124, as shown in FIG. 15. As canister 10 progresses along the conveyer, canister 10 is moved into a hot oven 124, as shown in FIG. 16. Oven 124 applies heat 126 to canister 10 to increase the temperature of product-storage region 18 until it reaches a retort temperature 132T that is greater than the pre-retort temperature 130T.

Container 12 and closure 20 initially remain rigid as the temperature of product-storage region 18 is below retort temperature 132T. Under the ideal gas law, an increase in temperature causes an increase in pressure, if volume is held constant. As such, the increased temperature causes the pressure 130P of product-storage region 18 to increase such that product-storage region 18 has a retort pressure 132P that is greater than the pre-retort pressure 130P, as suggested below the enlarged perspective view of canister 10 in FIG. 16.

Gasket 42 remains mated with brim 24 of filler neck 14 while canister 10 is in oven 124. As such, the product-storage region 18 remains sealed off from the atmosphere along with any products received within product-storage region 18 of canister 10. The pressure of product-storage region 18 may surpass retort pressure 132P such that it breaks the seal between gasket 42 and brim 24, allowing some of the air, or other gasses, sealed inside canister 10 to escape until the pressure of product-receiving cavity is reduced to retort pressure 132P and the seal is reestablished. Once the seal is reestablished, less air, or other gasses, is stored within product-storage region 18.

As the conveyer moves canister 10 out of oven 124, canister 10 cools to an ambient temperature. Once cooled, product-storage region 18 has a post-retort temperature 134T, pressure 134P, and volume 130V, as suggested below the enlarged perspective view of canister 10 in FIG. 17. Post-retort temperature 134T of product-storage region 18 is similar to pre-retort temperature 130T of product-storage region 18 because the ambient temperature outside of oven 124 is similar before and after oven 124. Post-retort pressure 134P and volume 134V of product-storage region are less than pre-retort pressure 130P and volume 130V of product-storage region 18 due to air escaping canister 10 when canister 10 was heated in oven 124.

In illustrative embodiments, a canister 10 includes a drainable closure 20 that permits fluid from on top of closure 20 to drain to an outside of a container 12 of canister 10. Fluid is drained through the top of closure 20 through top vents 79 into an interior region 56 of closure 20. The fluid drains through a helix angle of closure threads 30 of closure 20 and into lower vents 144 near the bottom of closure 20. Vents 144 are placed in shoulder 152 to allow fluid to drain and yet maintain a solid contact with a lower barrier ring 32 on neck 14 of container 12. Torque inhibitor 150 is configured to control the torque and subsequent compressive forces between the top of neck 14 and closure 20. Such forces may cause the top of a floating lid or disk 36 of closure 20 to break out of a lid-retainer ring 34 of closure 20.

Shoulder 152 is configured to engage with barrier ring 32 at the precise moment the closure disk reaches a sufficient compression force on the area of sealing between the floating lid 36 and the neck 14 of container 12. When closure 20 is removed from container 12, floating lid 36 will be broken away from neck 14 of container 12 by a disk pry-off feature 160. A top end of threads 30 on closure 20 is configured to act as a pry-off tool to break a seal of the floating disk 36 at one point on the circumference of the neck 14 to cock disk 36 rather than lift it vertically. This prying motion during rotation of closure 20 will significantly reduce the torque forces required to unscrew and remove closure 20.

The invention claimed is:

1. A canister comprising a container including a body formed to include a product-storage region, a filler neck coupled to the body and formed to include an open mouth arranged to open into the product-storage region, and container threads coupled to the filler neck and arranged to extend radially outward therefrom, a closure configured to mate with the filler neck to close the open mouth to block access to the product-storage region, the closure including a lid-retainer ring including a top wall, an annular side wall having a first end coupled to a bottom surface of the top wall and a second end extending from the bottom surface of the top wall toward the body of the container, and closure threads coupled to the annular side wall in an interior region of the lid-retainer ring and arranged to extend radially inward from the annular side wall toward the filler neck to engage with the container threads, and a floating lid trapped between the filler neck and the top wall, and torque-limiting means for limiting an amount of torque applied to the closure during installation of the closure on the filler neck of the container by blocking rotation of the closure relative to the filler neck so that a pre-determined sealing force is established between the floating lid and the filler neck wherein the torque-limiting means includes a shoulder provided by the second end of the annular side wall and a barrier ring extending circumferentially around and coupled to the filler neck and arranged to extend away from the filler neck toward the annular side wall to mate with the shoulder and engage the shoulder to block rotation of the lid-retainer ring when the pre-determined sealing force is established between the floating lid and the filler neck.

2. The canister of claim 1, wherein the barrier ring is located between the container threads and the body of the container.

3. The canister of claim 2, wherein the shoulder is located between the closure threads and the second end of the annular side wall.

4. The canister of claim 1, wherein the floating lid includes an upwardly facing outer surface arranged to face in an upward direction away from the container and a downwardly facing inner surface arranged to face in an opposite downward direction toward the container, the annular side wall is sized such that the bottom surface of the top wall is spaced a first distance from the shoulder, the filler neck is sized such that the barrier ring is spaced a second distance from a brim of the filler neck, and the upwardly facing outer surface of the floating lid is spaced a third distance from the downwardly facing inner surface of the floating lid, and the first and second distances are set in relation to the third distance such that the bottom surface of the top wall engages the upwardly facing outer surface of the floating lid to provide the predetermined sealing force between the floating lid and the brim of the filler neck.

5. The canister of claim 1, wherein the floating lid includes an upwardly facing outer surface arranged to face in an upward direction away from the container and a downwardly facing inner surface arranged to face in an opposite downward direction toward the container and the closure further includes fluid-drainage means for draining a fluid from the upwardly facing outer surface of the floating lid through an interior region formed in the lid-retainer ring and out a lower aperture formed in the lid-retainer ring when the floating lid is trapped between the filler neck and the lid-retainer ring.

6. The canister of claim 5, wherein the torque-limiting means includes a shoulder provided by the second end of the annular side wall and a barrier ring coupled to the filler neck and arranged to extend away from the filler neck toward the annular side wall to mate with the shoulder and engage the shoulder to block rotation of the lid-retainer ring when the pre-determined sealing force is established between the floating lid and the filler neck.

7. The canister of claim 6, wherein the fluid-drainage means includes a first groove formed in the bottom surface of the top wall and arranged to allow fluid communication from the top surface of the floating lid into the interior region of the lid-retainer ring and a first notch formed in the shoulder and arranged to allow fluid communication from the interior region past the second end of the annular side wall and outside the lid-retainer ring.

8. The canister of claim 7, wherein the fluid-drainage means further includes a spacing gap defined between an outer surface of the filler neck, an inner surface of the annular side wall, a lower portion of closure threads, and an upper portion of the container threads when the closure is coupled to the container, the spacing gap providing for fluid communication between the first groove and the first notch.

9. The canister of claim 8, wherein the shoulder cooperates with the barrier ring to form a runner gap defined between the outer surface of the filler neck, the inner surface of the annular side wall, the lower portion of the closure threads, and the barrier ring when the closure is coupled to the container.

10. The canister of claim 9, wherein the first groove provides fluid communication between the upwardly facing outer surface of the floating lid and the interior region of the lid-retainer ring, the interior region provides fluid communication between the first groove and the spacing gap, the spacing gap provides fluid communication between the interior region and the runner gap, the runner gap provides fluid communication between the spacing gap and the first notch, the first notch provides fluid communication between the runner gap and the lower aperture.

11. The canister of claim 1, wherein the floating lid includes an upwardly facing outer surface arranged to face in an upward direction away from the container and a downwardly facing inner surface arranged to face in an opposite downward direction toward the container and the lid-retainer ring further includes lid-removal means for overcoming a vacuum pressure in the product-storage region acting on a portion of the downwardly facing inner surface so that the floating lid is pried off the filler neck of the container during removal of the closure from the container.

12. The canister of claim 11, wherein the lid-removal means includes a pry ledge coupled to the annular side wall and arranged to extend away from the annular side wall toward the filler neck.

13. The canister of claim 12, wherein the closure threads include a first end positioned between the top wall and the second end of the annular side wall and a second end positioned between the first end of the closure threads and the second end of the annular side wall and the pry ledge is formed at the first end of the closure threads.

14. The canister of claim 13, wherein the pry ledge is spaced apart from and below the downwardly facing inner surface of the floating lid when the closure is coupled to the container and the predetermined sealing force is established.

15. The canister of claim 13, wherein the pry ledge engages a perimeter edge of the floating lid during rotation of the lid-retainer ring relative to the closure to cause the closure to be removed from the container.

16. The canister of claim 12, wherein the torque-limiting means includes a shoulder provided by the second end of the annular side wall and a barrier ring coupled to the filler neck and arranged to extend away from the filler neck toward the annular side wall to mate with the shoulder and engage the shoulder to block rotation of the lid-retainer ring when the pre-determined sealing force is established between the floating lid and the filler neck.

17. The canister of claim 16, wherein the closure further includes fluid-drainage means for draining a fluid from the upwardly facing outer surface of the floating lid through an interior region formed in the lid-retainer ring and out a lower aperture formed in the lid-retainer ring when the floating lid is trapped between the filler neck and the lid-retainer ring.

18. The canister of claim 17, wherein the fluid-drainage means includes a first groove formed in the bottom surface of the top wall and arranged to allow fluid communication from the top surface of the floating lid into the interior region of the lid-retainer ring and a first notch formed in the shoulder and arranged to allow fluid communication from the interior region past the second end of the annular side wall and outside the lid-retainer ring.

19. The canister of claim 18, wherein the fluid-drainage means further include a spacing gap defined between an outer surface of the filler neck, an inner surface of the annular side wall, a lower portion of closure threads, and an upper portion of the container threads when the closure is coupled to the container, the spacing gap providing for fluid communication between the first groove and the first notch.

20. A canister comprising a container including a body formed to include a product-storage region, a filler neck coupled to the body and formed to include an open mouth arranged to open into the product-storage region, and container threads coupled to the filler neck and arranged to extend radially outward therefrom, a closure coupled with the filler neck to close the open mouth to block access to the product-storage region, the closure including a floating lid having an upwardly facing outer surface arranged to face in an upward direction and a downwardly facing inner surface arranged to face in an opposite downward direction and a lid-retainer ring, the lid-retainer ring formed to include a lower aperture opening into an interior region formed therein and including a top wall, an annular side wall having a first end coupled to a bottom surface of the top wall and a second end extending substantially perpendicular from the bottom surface of the top wall, and closure threads coupled to the annular side wall in the interior region and arranged to extend radially inward from the annular side wall to engage with the container threads, the top wall arranged to cooperate with the filler neck to trap the floating lid therebetween, fluid-drainage means for draining a fluid from the upwardly facing outer surface of the floating lid through the interior region of the lid-retainer ring and out the lower aperture of the lid-retainer ring when the floating lid is trapped between the filler neck and the lid-retainer ring, and wherein the lid-retainer ring further includes a shoulder provided by the second end of the annular side wall and an annular tamper band coupled to the second end of the annular side wall and defining the lower aperture, and wherein the container further includes a barrier ring extending circumferentially around and coupled to the filler neck and arranged to extend away from the filler neck toward the annular side wall to mate with the shoulder when the closure is coupled to the container.

21. The canister of claim 20, wherein the fluid-drainage means includes an upper in-flow portion, a central mid-flow portion, and a lower out-flow portion defining a fluid passageway providing fluid communication between the upwardly facing outer surface of the floating lid and the lower aperture of the lid-retainer ring.

22. The canister of claim 21, wherein the upper in-flow portion includes one or more grooves formed in the bottom surface of the top wall of the lid- retainer ring, the central mid-flow portion includes a spacing gap defined between an outer surface of the filler neck, an inner surface of the annular side wall, a lower portion of closure threads, and an upper portion of the container threads when the closure is coupled to the container and a runner gap defined between the outer surface of the filler neck, the inner surface of the annular side wall, the lower portion of the closure threads, and the barrier ring when the closure is coupled to the container, and the lower out-flow portion includes one or more vents formed in the shoulder and one or more cut-outs formed in the tamper band.

23. The canister of claim 22, wherein the one or more grooves provide fluid communication between the upwardly facing outer surface of the floating lid and the interior region of the lid-retainer ring, the interior region provides fluid communication between the one or more grooves and the spacing gap, the spacing gap provides fluid communication between the interior region and the runner gap, the runner gap provides fluid communication between the spacing gap and the one or more vents, the one or more vents provide fluid communication between the runner gap and the one or more cut-outs, and the one or more cut-outs provide fluid communication between the one or more vents and the lower aperture.

24. A canister comprising a container including a body formed to include a product-storage region, a filler neck coupled to the body and formed to include an open mouth arranged to open into the product-storage region, and container threads coupled to the filler neck and arranged to extend radially outward therefrom, a closure configured to mate with the filler neck to close the open mouth to block access to the product-storage region, the closure including a lid-retainer ring including a top wall, an annular side wall having a first end coupled to a bottom surface of the top wall and a second end extending from the bottom surface of the top wall toward the body of the container, and closure threads coupled to the annular side wall in an interior region of the lid-retainer ring and arranged to extend radially inward from the annular side wall toward the filler neck to engage with the container threads, and a floating lid trapped between the filler neck and the top wall, and lid-removal means for overcoming a vacuum pressure in the product-storage region acting on a portion of the floating lid so that the floating lid is pried off the filler neck of the container during removal of the closure from the container.

25. The canister of claim 24, wherein the lid-removal means includes a pry ledge coupled to the annular side wall and arranged to extend away from the annular side wall toward the filler neck.

26. The canister of claim 25, wherein the closure threads include a first end positioned between the top wall and the second end of the annular side wall and a second end positioned between the first end of the closure threads and the second end of the annular side wall and the pry ledge is formed at the first end of the closure threads.

27. The canister of claim 26, wherein the pry ledge engages a perimeter edge of the floating lid during rotation of the lid-retainer ring relative to the closure to cause the closure to be removed from the container.

28. A canister comprising a container including a body formed to include a product-storage region, a filler neck coupled to the body and formed to include an open mouth arranged to open into the product-storage region, and container threads coupled to the filler neck and arranged to extend radially outward therefrom, a closure configured to mate with the filler neck to close the open mouth to block access to the product-storage region, the closure including a lid-retainer ring including a top wall, an annular side wall having a first end coupled to a bottom surface of the top wall and a second end extending from the bottom surface of the top wall toward the body of the container, and closure threads coupled to the annular side wall in an interior region of the lid-retainer ring and arranged to extend radially inward from the annular side wall toward the filler neck to engage with the container threads, and a floating lid trapped between the filler neck and the top wall, and lid-removal means for overcoming a vacuum pressure in the product-storage region acting on a portion of the floating lid so that the floating lid is pried off the filler neck of the container during removal of the closure from the container, wherein the lid-removal means includes a pry ledge coupled to the annular side wall and arranged to extend away from the annular side wall toward the filler neck, wherein the closure threads include a first end positioned between the top wall and the second end of the annular side wall and a second end positioned between the first end of the closure threads and the second end of the annular side wall and the pry ledge is formed at the first end of the closure threads, wherein the floating lid includes a first side and a second side opposite the first side and the closure threads cooperate with the container threads to provide means for tilting the lid-retainer ring during removal of the closure from the container to raise the pry ledge such that the pry ledge is the first surface to contact the perimeter edge of the floating lid on the first side of the floating lid to raise the first side of the floating lid and separate the first side of the floating lid from the filler neck to allow the pressure within the product-storage region of the container to raise from a vacuum pressure to an ambient environment pressure to reduce the vacuum force exerted between the floating lid and the product storage region and allow removal of the floating lid from the filler neck.

29. The canister of claim 28, wherein the container threads and closure threads are helical threads, the lid-retainer ring further includes an annular lid-carrier ring coupled to the annular side wall in the interior region between the top wall and the second end of the closure threads arranged to extend radially inward from the annular side wall to retain the floating lid within the interior region of the lid-retainer ring, and the pry ledge is arranged to contact the perimeter edge of the floating lid before the annular lid carrier contacts the perimeter edge on the second side of the floating lid.

* * * * *